United States Patent [19]

Clive-Smith

[11] Patent Number: 4,638,744

[45] Date of Patent: Jan. 27, 1987

[54] CORNER MECHANISM FOR COLLAPSABLE CONTAINER

[76] Inventor: Martin Clive-Smith, 151, Broomwood Road, London, SW11 6JU, England

[21] Appl. No.: 581,614

[22] Filed: Feb. 21, 1984

[30] Foreign Application Priority Data

Feb. 23, 1983 [GB] United Kingdom ..... 8304952
Jun. 1, 1983 [GB] United Kingdom ..... 8315092

[51] Int. Cl.[4] ..... B65D 19/12

[52] U.S. Cl. ..... 108/56.1; 108/53.1; 108/55.1; 248/346; 16/297

[58] Field of Search ..... 108/56.1, 55.1, 53.1, 108/53.3; 206/386, 600; 220/1.5; 248/346; 16/280, 284, 292, 297, 319, 289, 343

[56] References Cited

U.S. PATENT DOCUMENTS

| | | | |
|---|---|---|---|
| 1,997,239 | 4/1935 | Shea | 16/346 |
| 2,956,763 | 10/1960 | D'Area | 108/56.1 |
| 3,521,764 | 7/1970 | Loomis | 108/53.1 |
| 3,529,741 | 9/1970 | Walker et al. | 220/7 |
| 4,131,071 | 12/1978 | Glassmeyer | 108/56.1 |
| 4,240,359 | 12/1980 | Howe | 108/56.1 |
| 4,309,013 | 1/1982 | Howe | 108/56.1 |
| 4,319,732 | 3/1982 | Godfrey | 108/56.1 |
| 4,355,732 | 10/1982 | Nessfield | 220/1.5 |

FOREIGN PATENT DOCUMENTS

| | | | |
|---|---|---|---|
| 1432542 | 4/1976 | United Kingdom . | |
| 2076371 | 12/1981 | United Kingdom | 220/1.5 |
| 2097364 | 11/1982 | United Kingdom | 206/600 |
| 921983 | 4/1982 | U.S.S.R. | 206/600 |

*Primary Examiner*—Francis K. Zugel
*Assistant Examiner*—Mark W. Binder
*Attorney, Agent, or Firm*—Charles R. Rhodes; Judith E. Garmon

[57] ABSTRACT

A collapsable flat comprising a corner post (6) pivotally mounted to a stub post (23) provided at the corner of a loading platform (1) of the flat so that the corner post is pivotable out of an upright operational position into a collapsed stowed position and vice versa, interengaging latching means (28,51,52) provided by the stub post and the corner post remote from the pivotal connection (13) therebetween for holding the corner post relative to the platform in its upright operational position, resilient biasing means (35) interconnecting the corner post and the stub post partially to counterbalance the mass of the corner post during the pivotal movement and locking means (27) housed by the stub post for locking the collapsed flat to a similar flat said locking means being extendible from the stub post into an operative position, when the corner post is pivoted into its stowed position.

8 Claims, 13 Drawing Figures

CORNER MECHANISM FOR COLLAPSABLE CONTAINER

This invention relates to a collapsable container or so called collapsable flat having a platform for the use of transporting goods. It is common to load goods into rigid containers of a standard size, shape and strength. In the international shipping industry, the degree of standardisation covers a range of freight containers which have at each corner a special fitting which enables the containers to be handled, transported and secured by compatible standardised equipment such as trucks, rail wagons, ships and cranes, and which enables the containers to be stacked one upon another and secured to each other by securing devices.

The positioning of the corner fittings must be accurately maintained both in the unladen static state of the container, and in the dynamic and loaded condition such as when carried on board a sea going vessel in heavy seas, if the container is not to distort and become incompatible with the previously referred to handling devices and standardized equipment.

When empty of cargo, it is sometimes desirable to be able to fold the vacated container down to a fraction of its erected size, grouped with other like containers and transported back to the place where cargo is available. By this means, saving in carriage and storage may be made by virtue of the fact that the container when folded occupies less space than the erect container.

The mechanism by which the erect container may be folded yet maintain the structural and service requirements can be complex both for structural and geometric reasons. Desirable features of a collapsable flat include locking means to hold the container rigidly erect, corner fittings apparent when the container is folded, means to interlock the folded containers together so that they may be transported as one modular group, structural means to enable other laden containers to be stacked upon a folded container, and means for counterbalancing the walls of the folding container to enable manual erection and collapsing of these massive structures.

U.S. Pat. No. 3,529,741 discloses a collapsable container having a corner post which seats on a stub post. The corner post is locked in its upright position to the stub post by means of a twist-lock device carried by the stub post. The locking arrangement to maintain the post upright is complex and prone to seizure due to corrosion. Moreover, the construction generally is difficult to operate since no counterbalance force is provided to assist in collapsing and erecting the container.

British Pat. No. 1,432,542 discloses a collapsable flat in which a corner post is pivotally mounted at each corner of a base structure and is resiliently biased to assist the post in pivoting to and from an upright position. This known construction also is prone to seizure since a pin and aperture locking arrangement is provided. Moreover, this construction is not well adapted for compatibility with known cargo handling devices.

British Pat. No. 2,076,371 discloses a collapsable flat having corner posts each of which is pivoted about a stub post and interengages therewith by a tongue and aperture to hold the corner post vertically. A torsion spring is provided to bias the post to disengage the tongue and aperture. This construction also includes exposed components tending to make the mechanism prone to seizure.

The present invention offers a combination of features to meet all the listed desirable features and in addition offers a means of reducing the manufacturing costs through a reduction in machining of the assembled parts.

One aspect of the invention provides a collapsable flat comprising a corner post pivotally mounted to a stub post provided at the corner of a loading platform of the flat so that the corner post is pivotable out of an upright operational position into a collapsed stowed position and vice versa, interengaging latching means provided by the stub post and the corner post remote from the pivotal connection therebetween for holding the corner post relative to the platform in its upright operational position, resilient biasing means interconnecting the corner post and the stub post partially to counterbalance the mass of the corner post during the pivotal movement and locking means housed by the stub post for locking the collapsed flat to a similar flat said locking means being extendable from the stub post into an operative position when the corner post is pivoted into its stowed position.

So that the present invention may be more readily understood and so that the features may be appreciated embodiments of the invention will now be described, by way of example only, with reference to the accompanying drawings, in which.

Figure 1:
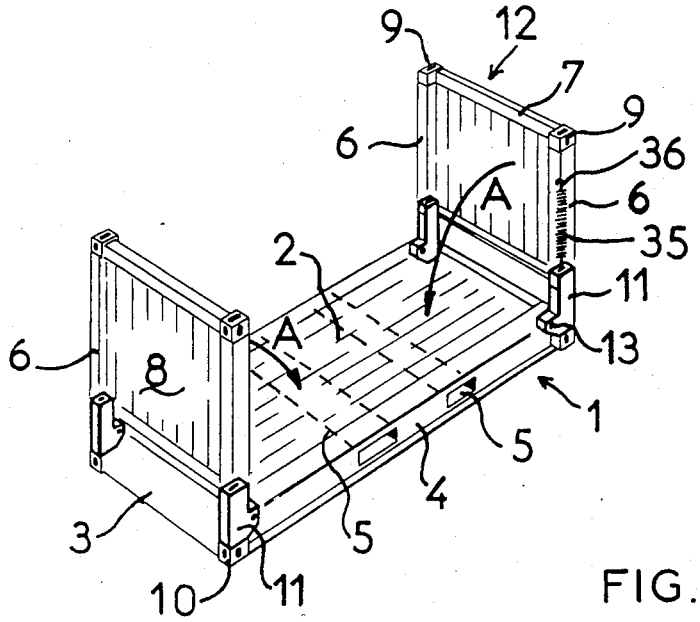
FIG. 1 is a perspective view of a typical collapsable container in erect condition.

Referring to the drawings, FIG. 1 illustrates a typical collapsable container or flat. There is generally provided a loading platform 1 decked with timber flooring 2 upon which cargo may be placed and lashed. the flooring 2 is supported by structural members 3, 4 and 5 which pass under the flooring 2 as indicated in broken lines. At each end of the container there is an endwall 12 comprising corner posts 6, upper transverse member 7, vertical panelling 8 and at the junction between the member 7 and the corner posts 6, a corner fitting 9. A similar corner fitting 10 is rigidly attached to the lower corners of the platform 1. Above the corner fitting 10 there is provided a corner assembly 11.

In the erected operational state as shown in FIG. 1, the endwalls 12 comprising the rigid structure 6,7,8,9 is locked by interengaging latching means within the corner assembly 11 to prevent their rotation about the pivot pins 13 in the direction of arrows 'A' down across the platform 1 and vice versa.

A spring 35 is anchored at its end 36 to the corner post 6 or endwall 12 and enters or is attached to the corner assembly 11, being so arranged as to counterbalance the weight of the endwall, or corner post at least at part.

Figure 2:
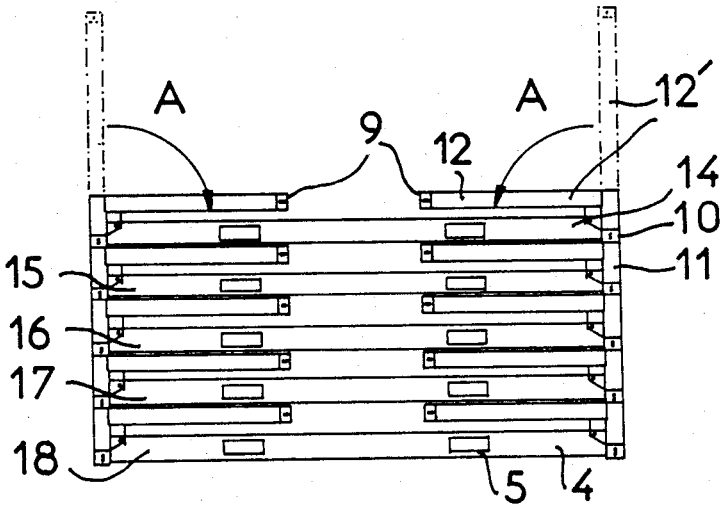
FIG. 2 is a side elevation of a stack of similar collapsable containers, in collapsed condition and piled one upon another and connected to form a unit that may be handled as one.

A number of similar collapsed containers 14,15,16, 17,18 are shown in FIG. 2 stacked one upon another. The top container 14 shows, in elevation, the position of the erect endwall 12' in broken lines and the rotational direction of arrow A. It can also be seen that the lower corner fittings 10 of one container rest upon the upper part of the corner assembly 11 of a lower container.

Figure 3:
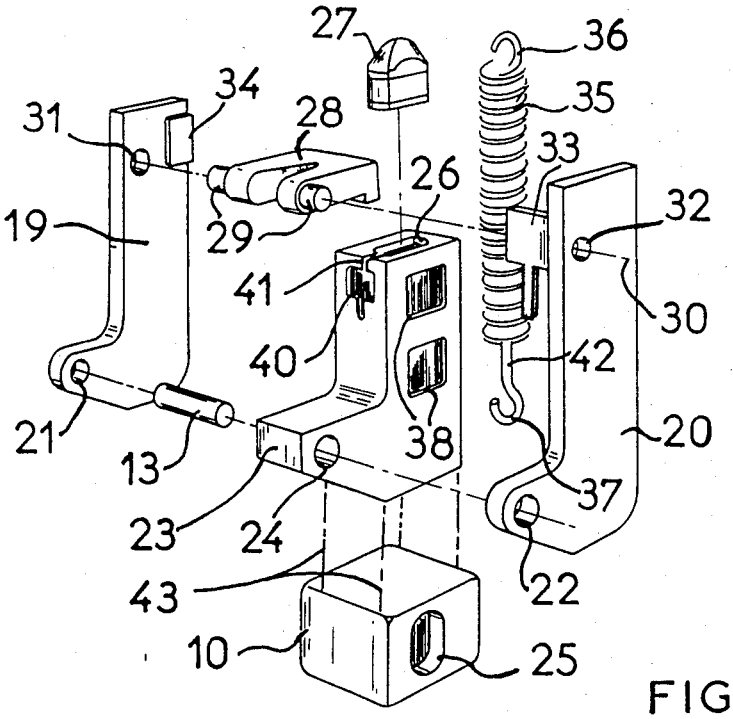
FIG. 3 is an exploded view showing some of the parts which comprise a corner hinging and locking mechanism of a collapsable container.

Referring now to FIG. 3, there is shown in exploded view some of the parts which form the corner assembly 11. The assembly comprises a pair of generally L-shaped flank plates 19,20 which have pivot holes 21,22 respectively. The flank plates are pivotally mounted at the toe of a hollow stub post 23 having pivot hole 24 passing through it by means of a pivot pin 13. When assembled the holes 21,22 24 share a common axis with the pivot pin 13, and the flank plates 19,20 are mounted upon the pivot pin 13, so that they may move pivotally in relation to the stub post 23 to and from an erect position in which the flank plates lie adjacent opposed faces of the stub post. The stub post 23 is secured to a lower corner fitting 10, which includes a handling aperture 25 in one of its exposed sides.

In manufacture, the corner fitting 10 usually is welded to the stub post 23. Typically, the construction material of the corner assembly 11 and containers is a high strength steel with flooring 2 of timber or of steel.

A further handling aperture 26 is provided in the top of the stub post 23 through which handling devices similar to the interlocking device 27 may pass. It should be noted that the interlocking device 27 and the handling aperture 26 both have an elongate shape in plan view.

A latching element 28 which incorporates a trunnion 29 projecting from each of its sides is pivotally mounted between the flank plates. The axis 30 of the trunnions 29 is coaxial with the axis 30 of holes 31,32, formed in the plates 19,20 and, in full assembly, the trunnions 29 pass freely through the holes 31, 32 so that the latching element 28 is captured by the plates 19,20 but can move pivotally about the axis 30.

A 'T' spacer profile plate 33 has an upper part which keeps the flank plates 19,20 at the correct position apart to allow free pivotal movement of the latching element 28. A stop plate 34 is rigidly attached to plate 19 (which will be referred to later) and a similar stop plate (not shown) is attached to flank plate 20.

A pair of rectangular apertures 38 are formed in the side of the stub post 23 and a further opening 40 is formed in the front face of the stub post. A slot 41 interconnects openign 40 and handling aperture 26.

In operation, the lower hook 37 of a counterbalance spring 35 passes through the handling aperture 26 and is attached to a mechanism (to be described hereinafter) within the stub post 23. The neck 42 of the hook 37 and the stem of 'T' spacer plate 33 is able to pass through the slot 41 during pivotal operation of the assembly as will be described later.

It can be seen (FIG. 6) that the combined height of the stub post 23 and the lower corner fitting 10 determines the height of a container 15,16,17,18 when in collapsed condition. If it is required to increase the height of the corner asembly, a structural spacing member 43 shown in broken lines is interposed between the corner fitting 10 and the stub post 23 and rigidly welded or otherwise attached. Thus, many variations in container bases 1 and corner posts 6 dimension may be accommodated by the simple introduction of selected spacing members 43 without involving the cost of varying the other components of the assembly.

Figure 4:
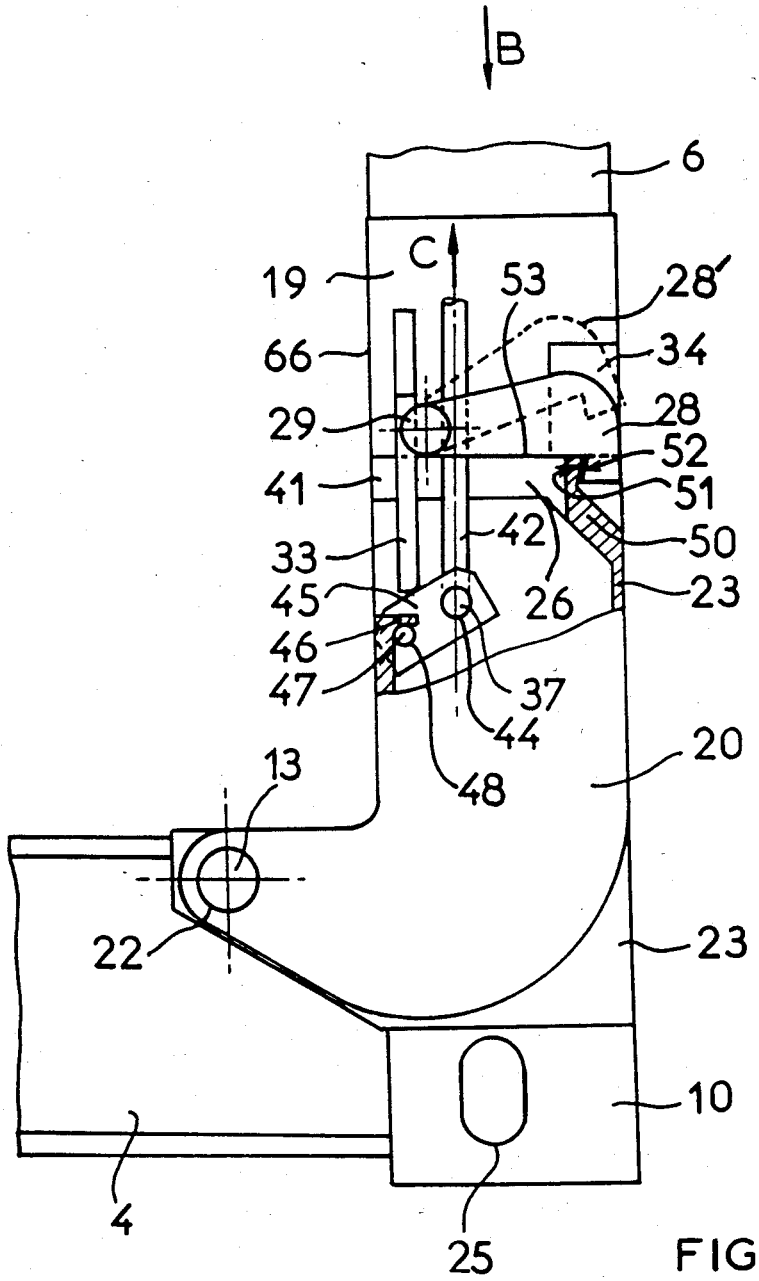
FIG. 4 is a detailed side elevation, but away in part, to reveal details of a corner assembly with the corner post in the erect and locked position.

FIG. 4 shows a side elevation of one corner assembly in which part of the side rail 4 is attached to the bottom corner fitting 10 and stub post 23. The flank plate 20 is cut away to reveal parts of the stub post 23. The stub post 23 is partly sectioned to reveal the top aperture 26 through which passes the neck 42 of the counterbalance sping 35 (not shown here) and the spring hook 37 which is pivotally anchored in a hole 44 formed in one end of a cam plate 45. The cam, or anchoring plate 45 has its opposite end attached pivotally to the stub post 23 at an inwardly projecting lip 46. A pin 47 is fastened rigidly by welding or other means to the lip 46 and passes freely through a second hole 48 in the cam plate 45. The stem of the spacer plate 33 whose upper part is rigidly attached to the flank plates 19,20 also passes through the aperture 26. The lower end of the spacer plate stem bears on the upward face of the cam plate 45 intermediate its pivotal attachments.

Whereas one end of the aperture 26 is slotted at 41, the opposite end of the aperture 26 is closed by structure 50. The latching element 28 incorporates a projecting lip having a downwardly divergent face 52 located in engagement with a mating latching face 51 which slopes inwardly at an angle similar to the face 52 thereby to increase the contact area between those faces.

In operation, the erect corner post will be in the position shown in FIG. 4 such that the lower face of the stop plates 34 make direct contact with the upper face 53 of the stub post 23, thereby seating the corner post on the stub post and preventing the corner post 6 from rotating further clockwise about the pivot pin 13. To prevent rotation of the corner post 6 in the anti-clockwise direction, the latching element 28 acts via its face 52 on face 51 to hold the flank plates 19,20 and thence the corner post in an erect operational position. To free the corner post 6 so as to allow it to be rotated about the pivot pin 13 down towards the loading platform of the container, the latching element 28 is rotated about the pivot formed by trunnions 29 until it is in position 28' shown in broken lines whereby the faces 51,52 are then parted.

It will be appreciated that the weight of the endwalls 12 can be immense and too great for manhandling, especially since the centre of gravity of the ednwalls 12 may act in the direction and position of arrow B causing a clockwise moment about the pivot pin 13. This clockwise movement must be overcome by an opposite force in an anti-clockwise direction if the corner post 6 and-/or endwall 12 is to be collapsed on to the base 1. Thus counterbalance spring 35 is provided to contribute a lifting force during pivotal movement of the corner post 6.

In the position shown in FIG. 4, the spacer plate 33 bears on the cam plate 45. The spring 35 is tensioned thereby pulling in direction of arrow C through the neck 42, hook 37 and hole 44, causing the cam plate 45 to bear on the spacer plate 33 and try to rotate anti-clockwise about its pivot pin 47. The tension in the spring 35 may be adjusted by suitable means (not shown) to vary the force with which the cam plate 45 bears against the spacer plate 33. It can be seen that the force could be increased to a level whereby the endwall 12 is caused to rotate about the pin 13. In practice, a force sufficient to give complete lifting of the corner post or endwall is unnecessary and the bearing force would normally be set to balance partly the dead weight of the end wall 12 (or post 6) so that the post or end wall 12 can be manually collapsed with relative ease.

Figure 5:
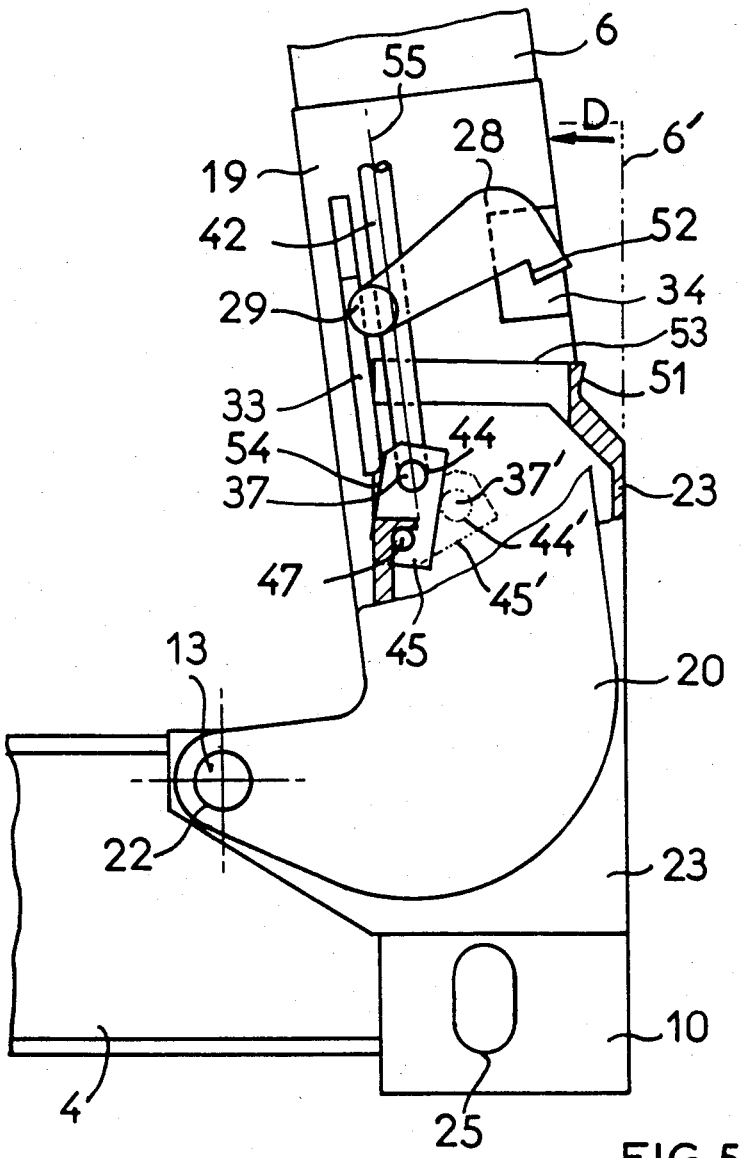
FIG. 5 is a side elevation similar to FIG. 4 but with the corner post of the container pivoted a short distance towards the collapsed position.

Referring to FIG. 5 in order to pivot the endwall or post 6 towards its collapsed condition, a force in direction of arrow D is applied to flank plates 19,20 or end-wall 12 or corner post 6 such that the combination of the pivotal force applied with the tension in the spring 35 and the action of the spring 35 acting through the neck 42 to the hook 37, thence to the cam plate 45 and through to the spacer plate 33 is sufficient to move the enwall 12 readily towards its collapsed position. As the endwall 12 moves, so too does the spacer plate 33 about the same pivot 13. In so doing the lower end of the spacer plate 33 moves away from the pivot pin 47 which is fixed to the stub post 23. Because of the tension in the spring neck 42, the cam plate 45 also rotates anti-clockwise about its pivot 47 in an attempt to maintain contact with the spacer plate 33. The original position of the corner post 6 is denoted by the broken line 6' and the original position of the cam plate 45 is denoted by the broken line 45'.

The rotation of the cam plate 45 thereby causes the hook 37 captured in hole 44 to move upwards slightly towards the top of the corner post 6. This upward movement has the effect of shortening the extended length of the spring 35 since its upper end hook 36 is anchored at some point (not shown) to the corner post 6, which therefore has the effect of reducing the tension in the spring 35. The assembly can be adjusted such that when the centre of gravity of the endwall 12 acts vertically through the pivot 12 or substantially so (or is near to it) the tension in the spring 35 is negligible. Hence, in the absence of any force in direction of arrow D, and with the cam plate 45 merely resting lightly on the spacer plate 33, the endwall 12 would be in unstalbe equilibrium.

Although the tension in the spring 35 can be selected to give the desired rotational force through to the spacer plate 33 via cam plate 45, when the corner post 6 is in its erect position 6', at intermediate positions of the corner post 6 and endwall 12, the tension in the spring may also be varied as will be further discussed.

It can be ovserved in FIG. 5 that the lower end of the spacer plate 33 is near the top of the cam plate 45 when the corner post is tilted whereas in FIG. 4 when the corner post is erect it is nearer the lower part of the cam plate 45. The edge 54 of the cam plate 45 is shown here as straight but it may be shaped so that as the spacer plate 33 moves along the edge 54, differing positions of the cam plate 45 and thus the hook 37 and extension of the spring 35 may be achieved as compared to the example already described. The profile of the edge 54 may be selected to give various tensions in spring 35 as required.

If pivotal force is continued to be applied in the direction of arrow D, the post 6 continues to rotate thereby taking the spacer plate 33 out of contact with the cam plate 45. However, as the axis 55 of the spring 35 and neck 42 passes through the holes 44,48 and the corner post 6 continues to rotate, the anchored end 36 of the spring 35 moves away from the captured hook 37 in hole 44. This causes the spring 35 to extend again and builds up a tension in it. The centre of gravity of the endwall 12 will also be shifting away from the pivot 13 whereby the mass of the endwall is counterbalanced at least partially be the increasing tension in the spring 35.

Figure 6:
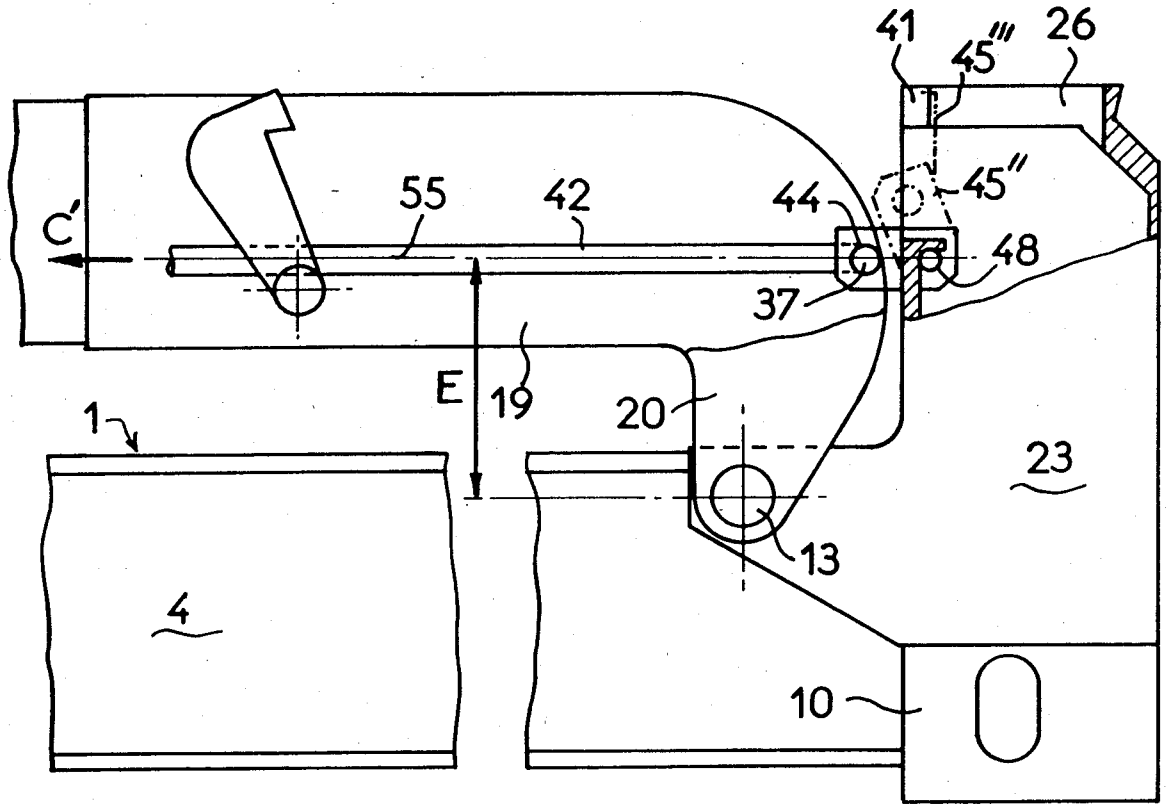
FIG. 6 is a side elevation similar to FIG. 5 but with the corner post fully pivoted i.e. collapsed down onto the container loading platform.

Referring now to FIG. 6 the corner post 6 can be seen collapsed down almost on top of the loading platform 1 and side rail 4. With the corner post 6 in this position, the anchored end 36 of the spring 35 is furthest from the hook 37 and therefore there is maximum tension in the spring 35. The centre of gravity of the endwall 12 in this collapsed position also is furthest from the pivot 13 about which it acts thereby balancing to some degree the increased tension in the spring 35. When equally balanced, only a small lift force on the corner post 6 would be needed to raise the endwall 12. The cam plate 45 is shown in a freely rotated position such that the spring axis 55 passes horizontally through the holes 44, 48.

The tension in the spring 35 acts substantially in the direction of the axis 55 and along the neck 42. The lifting moment on the endwall 12 that the spring 35 can exert is governed by the distance E, being the perpendicular distance from the spring axis 55 to a notional horizontal plane passing through the centre of the pivot 13. If the cam plate 45 were restricted in its movement such that it could not move past the position 45" shown in broken lines, it can be seen that the distance E would be increased, thereby increasing the lifting moment of the spring 35. In practice, this would allow a lighter strength spring to be used to achieve the same lifting moment. Any obstruction to the handling aperture 26 that the cam plate 45" might have can be arranged by adjustment of the position of the abutments which prevent the further rotation of the cam plate 45. Furthermore adjustment of final spring tension and lifting moment could be made through provision of an adjustable stop position of the cam plate 45".

The slot 41 provided in the handling aperture 26 may not be desirable in some circumstances such as when a lifting device entering through the handling aperture 26 needs full support in the vicinity of the slot 41. Access to the aperture 26 is only available when the corner post 6 is collapsed and the cam plate 45 is fully rotated anti-clockwise. Thus, it is envisaged that the cam plate 45 might rotate to a position in which it closes the slot 41 and provides the closure of aperture 26 that may be required. The shape of the cam plate 45 may be formed to suit the several geometric functions that may be required of it, such as extending it to dotten line 45'''.

Figure 7:
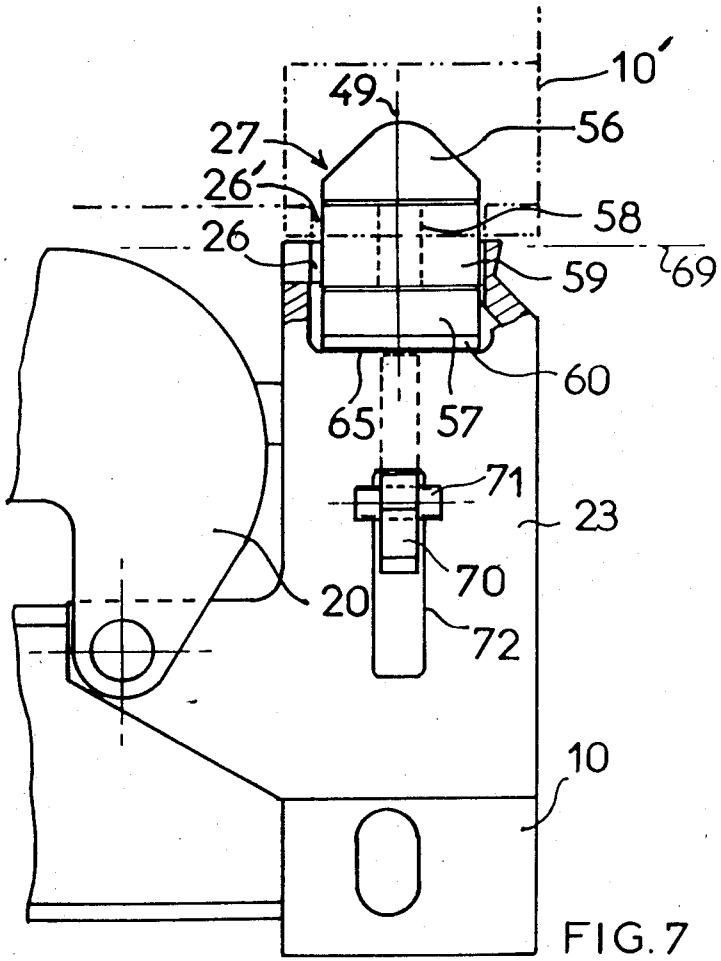
FIG. 7 is a side elevation similar to FIG. 6 but showing an interlocking device projecting out of the top of the stub post ready to receive a second container placed over it.

FIG. 7 is a side elevation similar to FIG. 6 but showing an interlocking device 27 projecting from the handling aperture 26. The interlocking device 27 comprises a conically shaped head 56 which is rigidly connected to a tail 57 by the shaft 58 shown in broken lines which passes through a collar 59. Rotation of the head 56 causes the tail 57 to rotate simultaneously since the shaft 58 is free to rotate within the collar 59 about a common vertical axis 49. The interlocking head 56, collar 59 and tail 57 can normally pass through the elongage shape of handling aperture 26, but when rotated through an angle of 90 degrees or so in a horizontal plane about axis 49, the head 56 and tail 57 can no longer pass through the aperture 26.

Thus when a second container indicated in broken lines with lower corner fitting 10° is placed on top of the stub post 23, the interlocking device 27 may be operated to lock into the aperture 26' in the lower corner fitting 10' thereby locking the two containers together so that they may be moved as one.

Figure 8:
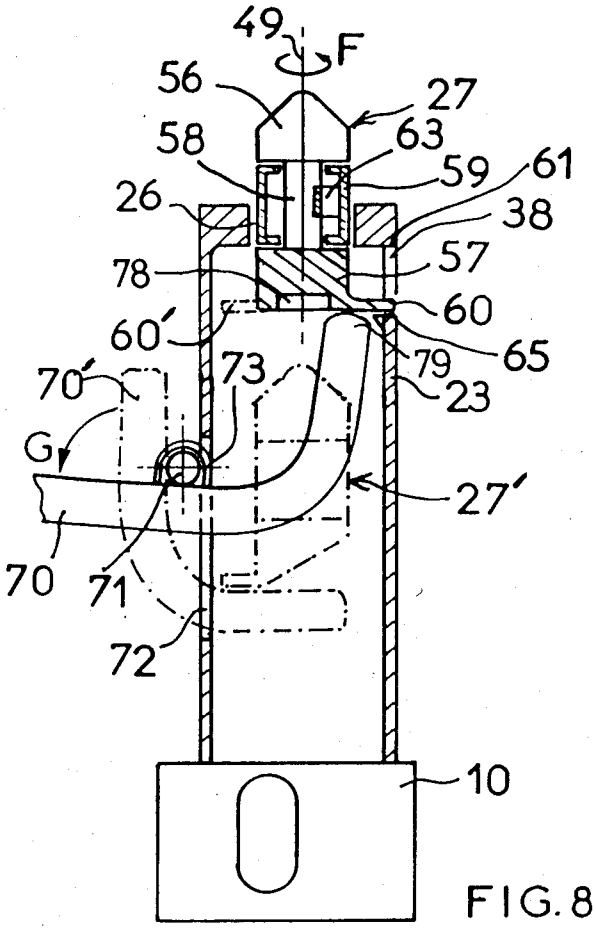
FIG. 8 is an end elevation showing the same interlocking device as FIG. 7 but with the device rotated into a position which prevents it from dropping back into a stowed position.

FIG. 8 shows an end elevation of part of the stub post 23 and the interlocking device 27, both of which are cut wasy to reveal details within. The collar 59 is hollow so that the shaft 58 passes freely through it to connect together the head 56 and tail 57. The tail 57 has a lip 60 projecting from one side which engages a side aperture 38 in the wall of the stub post 23. The aperture 26 surrounds the collar 59 supporting it on both sides horizontally. In operation, it may be desired to lower a second container such as 14 onto 15 as in FIG. 2 to link them together. However, when lowering the container 14 onto the container 15, the lower corner fitting 10' shown in FIG. 7 may contact and arrest against the head 56 of the interlocking device 27 through mislocation rather than allowing the head 56 to pass freely through the aperture 26'. Therefore it is desirable for the interlocking device 27 to be held firmly in the projecting position. This is achieved by providing a ledge 65 on which the tail lip 60 rests and is augmented by the support provided to the collar 59 by the walls of the aperture 26.

When it is desired to remove the interlocking device 27 from its projecting position, it is usual to allow it to drop down through the aperture 26 to a stowed position within the stub shaft. However, the tail lip 60 prevents this. To release the lip 60 from the ledge 65, the head 56 may be rotated horizontally as indicated by arrow F through 180 degrees about axis 49. This movement rotates the tail 57 through 180 degrees so that the lip 60 moves to the position 60' shown in dotted line. Here the tail lip 60 is clear of obstruction vertically and the interlocking device 27 may be dropped or be lowered away from the aperture 26.

When locking another container 14 through its lower corner fittings 10 to the stub post 23 of a second container 15, the rotation of the interlocking device 27 maybe achieved by placing a hand or tool through the side aperture 38 to rotate the tail 57 or lip 60.

Figure 9:
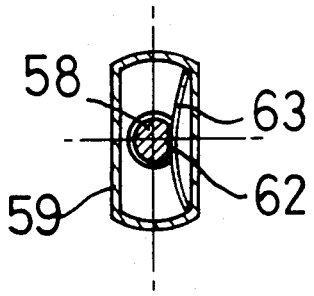
FIG. 9 is a cross-sectional view taken through a horizontal plane of the interlocking device.

To lock the tail 57 and head 56 in the interlocking position or other position a detent spring arrangement may be provided such as that shown in FIG. 9. The plan section through the shaft 58 and collar 59 reveals that the shaft 58 includes a flat portion 62. A spring 63 is supported by the collar at 64 and bears on the shaft 58. When the shaft 58 rotates, the flat portion 62 moves away from the spring 63 and because the circualr part of the shaft 64 is projects further than the flat 62, the spring is compressed. As soon as the flat 62 is presented again to the spring 63 the spring 63 deflects into the flat 62. Thus, to rotate the shaft 58, and head 56 and tail 57 it is necessary to overcome the force provided by the spring 63. Other flats may be provided on the shaft 58 to allow the spring 63 to hold the head 56 and tail 57 in other selected positions.

Referring again to FIG. 4 the latching element is captivated in holes 31 and 32, and the latching face 51 of the stub post 23. It is envisaged that the latching element 28 may be retained by means other than pivotally. For example, the latching element may be hooked on or keyed onto the flank plates 19,20. Likewise the latching face 52 and stub post latching face 51 may be shaped to give a wedging action such as it shown in FIG. 13 or other desired action to achieve locking. The latching element 28 may to dropped, lowered, slid or pivoted into place and guides may be provided by the flank plates 19,20 to guide the latching element 28 into the locked and released position. The latching element 28 may also be adpated to lock into the handling aperture 26.

The spring 35 described is a helical tension spring but other spring arrangements are envisaged with differing geometric mountings and applications. The spring may be a helical coil spring with a tension rod or tube linked to the hole 44 in the cam plate 45 and the spring supported or anchored to the corner post 6 or endwall 12. In another arrangement, the spring may be anchored to the base 1 of the container and act through cam plates suitably positioned among the pivot pin 13 of the stub post 23, and again the spring may be a tension, compression, torsion, leaf, disc, hydraulic, pneumatic or other combination to provide the requisite resilient biasing. The spring may be mounted adjacent to the corner post 6 or at the centre of the endwall 12 and not necessarily act through the aperture 26 in the stub post.

Figure 11:
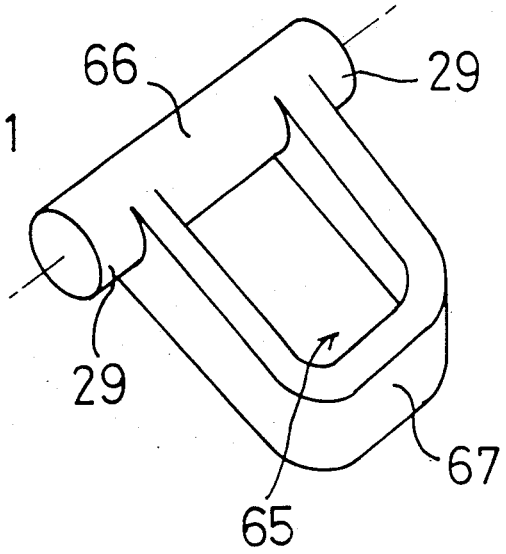
FIG. 11 is a perspective view of the locking device of FIG. 10.

In a modified construction, the latching element 28 may be shaped as in FIG. 11 whereby an aperture 65 is formed by loop 67. The trunnions 29 may be joined by a member 66 to close the aperture 65 if desired.

Figure 10:
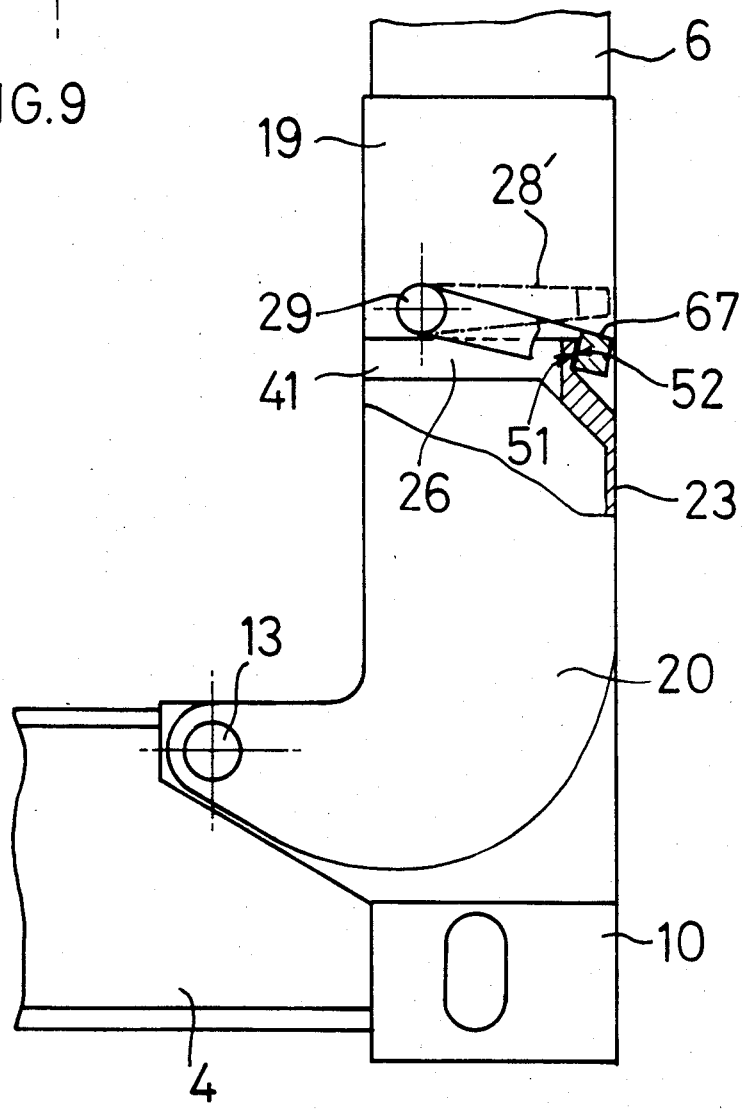
FIG. 10 is a view similar to FIG. 4 buth with another locking arrangement.

In operation, seen in FIG. 10, the latching element is locked by means of enveloping either fully or partially the top of the stub post 23 such that the face 52 comes behind face 51 and thereby prevents rotational movement of the corner post 6. To release the latching element 28, the loop 67 may be lifted thereby rotating the hook 28 about the axis 30 to a position indicated by broken lines 28' whereby the face 52 is clear of the face 51. The corner post 6 may then be rotated anticlockwise about pivot pin 13.

It is envisaged that the rotational axis 30 of the latching element 28 may be in a vertical plane so that the latching element rotates in from the sides of the stub post 23 rather than as described herein. Alternatively, the latching element 28 may be mounted upon the loading platform 1 or stub post 23 latching on a suitably shaped face attached to the post 6 to prevent rotation of the post 6.

Figure 12:
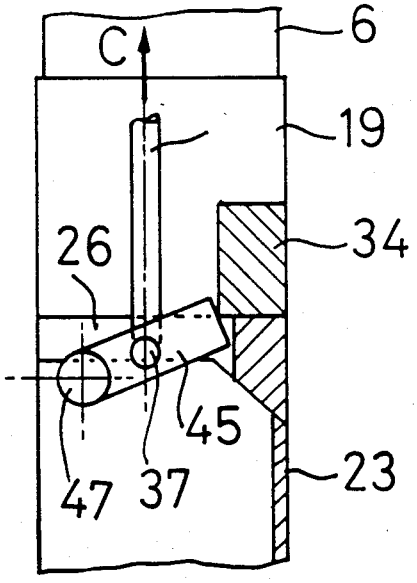
FIG. 12 is a partial side elevation of the corner and stub post showing yet another locking arrangement and, FIG. 13 is a partial side elevation of the corner and stub post showing a safety lock device.

In another arrangement of the container as seen in FIG. 12 the latching element 28 is omitted and the locking of the corner post 6 in the erect position is provided by the cam plate 45. The cam plate 45 may be extended so that it projects through the aperture 26 and abuts against a rigid portion of the plate 34. To release the cam plate 45, it is rotated clockwise about the pin 47 against the action of the spring 35 until clear of the plate 34 when the post 6 may be rotated anticlockwise. Alternatively, the cam plate 45 might be pivotally mounted on the corner post 6 and engage in the erect position of the post 6 with the stub post 23 and released by rotation about its pivot pin.

In a further modification of the invention, and with reference to FIG. 8, sufficient clearance between the aperture 23 and the collar 59 may be provided to allow the lip 60 to be released from the ledge 65 by movement of the whole interlocking device 27 both upwards and in a clockwise direction about axis 69 shown in FIG. 7.

Further, the interlocking device 27 may be assisted from the retracted position 27' to the raised position 27 by means of a lever 70. The lever 70 is attached to the stub post 23 pivotally at pin 71 via a bracket 73. In the rectracted position of the interlocking device 27' the lever is shown in dotted line 70'. By application of a force in the direction of arrow G on the lever 70, the lever 70 is caused to rotate about the pivot pin 71 thereby lifting the interlocking device 27 upwards. The bottom face of the tail 57 is formed with a recess in which the nose 79 of lever 70 engages. Thus, the lever can be operated to raise the interlocking device 27 and hold the tail 57 and lips 60 in a horizontal location thereby preventing vertical disengagement of the lip 60 from support 65. Other forms of lever and position of the lever are envisaged to suit the geometric and structural requirements.

Figure 13:
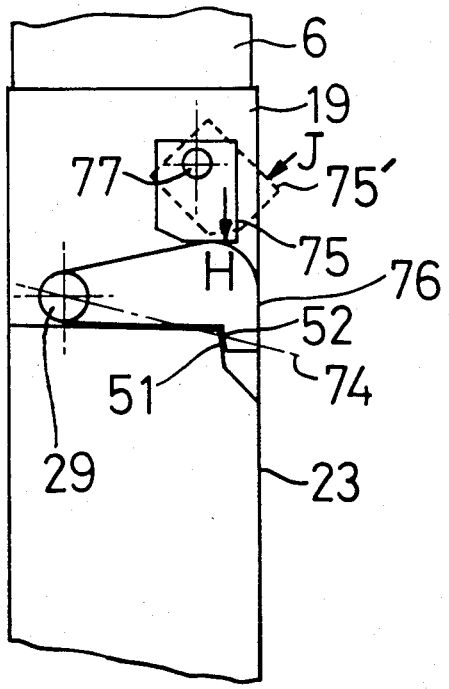

FIG. 13 illustrates a further improvement of the invention in which there is provided safety locking means to hold the latching element 28 in the locked position. It may be seen in this arrangement that the latching faces 51,52 are inclined to the axis 74 which passes through the centre of the trunnions 29. If there is little friction between the faces 51,52 as force is applied through the trunnions 29 to the face 52 of the latching element 28, there will be a tendency for the faces 51,52 to slide over one another thereby releasing the latching element 28 from the secure and locked position.

Thus to prevent the accidental release of the latching element 28, a safety locking means 75 may be provided which acts on the free end 76 of the latching element 28. The locking means 75 may be pivotally attached to the flank plate 19 so that to release the latching element 28, it is necessary to rotate the locking means 75 about the pivot pin 77 to the position shown in dotted line 75' to allow release of the latching element 28.

In some circumstances, the post 6 may be obstructed from full erection by dirt or friction in its path such that the face 52 of the latching element 28 cannot fully overlap face 51. By applying a force in the direction of the arrow H a wedging action is realised which pulls the latching element 28 into the locked position thereby fully erecting the corner post 6. The force in the direction of arrow H may be provided by shaping the end 78 of the locking means 75 so that a force in the direction J itself wedges the latching element 28 and drives it into full engagement with 51.

What is claimed is:

1. A collapsible flat having a loading platform, a stub post extending upwardly form each corner of said loading platform and having an outer profile surface on the upper, outer edge thereof opposite a corner post pivotally mounted about a pivot axis to each tub post so that the corner post is selectively pivotable out of an upright operational position into a collapsed stowed position and vice versa, said stub post being exposed only when the corner post is collapsed, a top handling aperture in the uppermost surface of said stub post, a latching device pivotally mounted between the walls of said corner post and, in the operational position, engaging said stub post to securely hold the corner post in its upright operational position, said latching device engaging the outer profile surface of the upper end of said stub post which is the furthest possible point on the stub post as measured diagonally from said pivot axis between the corner post and said stub post, whereby the distance between the pivot point and the latching point is maximized to reduce play in the upright corner post as much as possible.

2. A collapsible flat according to claim 1, wherein the latching device is a pivotal member having an angular wall across the free end thereof and pivotal about an axis parallel with the axis of rotation of said corner post.

3. A collapsible flat according to claim 2, wherein the angular wall of said pivotal member comprises an angled locking face and said outer profile surface of the stub post is formed to provide a cooperating locking face, said cooperating locking faces, when engaged, forming a plane perpendicular to the line of force tending to disrupt said latching device thereby more securely locking said corner post to said stub post.

4. A collapsible flat according to claim 1, wherein locking means is housed by said stub post for locking the collapsed flat to a similar flat, said locking means being extendible from the stub post into an operative position when said corenr post is pivoted into its stowed position.

5. A collapsible flat according to claim 1, wherein resilient biasing means interconnect said corner post and said stub post partially to counterbalance the mass of the corner post during its pivotal movement.

6. A collapsible flat according to claim 5, wherein said resilient biasing means has one end connected to said corner post and an opposite end pivotally connected to said stub post, movable anchoring means provided by said stub post to which said opposite end of the resilient biasing means is attached whereby said pivotal connection is movable so that said resilient biasing means augments the lifting movement required to pivot the corner post from its upright operational position into its collapsed stowed position and thereafter to at least partially counterbalance the mass of said corner post as it approaches its collapsed stowed position and vice versa when return pivoting said corner post into its upright opeational position.

7. A collapsible flat according to claim 6, wherein said resilient biasing means comprises a single acting spring which lies within the profile of said corner post and said stub post when said corner post is in its upright operational position.

8. A collapsible flat according to claim 6, wherein said resilient biasing means comprises a tension spring and said anchoring means comprises a plate, said anchoring plate having a cam surface which bears against a fixed follower carried by said corner post so as to create said lifting movement.

* * * * *